US007510627B2

(12) United States Patent
Uryu et al.

(10) Patent No.: US 7,510,627 B2
(45) Date of Patent: Mar. 31, 2009

(54) ACOUSTIC PAPER DIAPHRAGM AND ACOUSTIC TRANSDUCER APPARATUS

(75) Inventors: Masaru Uryu, Chiba (JP); Kunihiko Tokura, Tokyo (JP)

(73) Assignee: Sony Corporation, Tokyo (JP)

( * ) Notice: Subject to any disclaimer, the term of this patent is extended or adjusted under 35 U.S.C. 154(b) by 384 days.

(21) Appl. No.: 11/081,626

(22) Filed: Mar. 17, 2005

(65) Prior Publication Data

US 2005/0211402 A1 Sep. 29, 2005

(30) Foreign Application Priority Data

Mar. 19, 2004 (JP) ..... 2004-081242

(51) Int. Cl.
*D21F 11/00* (2006.01)

(52) U.S. Cl. ..... 162/138; 162/158; 162/164.1; 427/361

(58) Field of Classification Search ..... 162/138, 162/158, 164.1; 381/398, 423; 427/361, 427/365

See application file for complete search history.

(56) References Cited

U.S. PATENT DOCUMENTS

| | | | | |
|---|---|---|---|---|
| 6,183,814 | B1 * | 2/2001 | Nangeroni et al. | 427/361 |
| 6,371,241 | B1 | 4/2002 | Yamada et al. | |
| 2002/0096298 | A1 | 7/2002 | Uryu et al. | |

FOREIGN PATENT DOCUMENTS

| | | |
|---|---|---|
| CA | 2057669 A1 | 6/1993 |
| JP | 09-084175 | 3/1997 |
| JP | 2001-298791 | 10/2001 |

* cited by examiner

*Primary Examiner*—Mark Halpern
(74) *Attorney, Agent, or Firm*—Oblon, Spivak, McClelland, Maier & Neustadt, P.C.

(57) ABSTRACT

An acoustic paper diaphragm excellent in moisture resistance and acoustic characteristics and not impairing the biodegradability is provided.

An acoustic paper diaphragm is formed of paper in which polylactide resin emulsion that is a biodegradable polymeric material is internally added as a sizing agent.

3 Claims, 2 Drawing Sheets

ACOUSTIC PAPER DIAPHRAGM AND ACOUSTIC TRANSDUCER APPARATUS

BACKGROUND OF THE INVENTION

1. Field of the Invention

The present invention relates to an acoustic paper diaphragm and an acoustic transducer apparatus including the acoustic paper diaphragm, that is, mainly a loudspeaker.

2. Description of the Related Art

Paper diaphragms made from pulp by means of a papermaking method (a method of making a sheet of paper) are typically used as acoustic diaphragms provided in acoustic transducer apparatuses such as loudspeakers. With moisture-absorption characteristics, paper absorbs moisture depending on the moisture condition of the environment in which the paper is used, which greatly affects Young's modulus, strength and the like that are important to acoustic diaphragms. In order to minimize this effect, treatment called "sizing" is applied to paper diaphragms and moisture resistance is improved.

Sizing treatment is practically classified into two kinds, that is, internal addition and external addition and generally classified as shown in FIGS. 3A and 3B. Internal addition is the sizing treatment executed when making a sheet of paper as shown in FIG. 3A. External addition is, as shown in FIG. 3B, the sizing treatment in which a sizing agent is applied to paper after it is made, or in which paper is impregnated with a sizing agent after it is made. Internal addition is the treatment in which a sizing agent exists inside paper layers, and part of which is made to be exposed on the surface. On the contrary, external addition is the treatment in which a sizing agent is not contained much inside paper layers but is made to cover the surface.

As a sizing agent used for internal addition, what is called "latex" in which particles of natural rubber or synthetic rubber are dispersed in water is often used. Other than latex, a number of materials such as transformed natural resin (pine resin) and the one made from synthetic macromolecules are used as sizing agents. In the internally-adding sizing treatment in a general papermaking method, after a sizing agent is added to and dispersed in what is called pulp slurry in which pulp that is raw material for paper is dispersed in water in advance, an aluminum sulfate ($Al_2(SO_4)_3 18H_2O$) solution is added as a sizing-agent fixing agent to fix the sizing agent on the surface of pulp fiber. Paper is obtained by making this pulp slurry into a sheet. Sizing effectiveness such as improvement in properties (strength and so on) and moisture resistance can be obtained in a drying process when making a sheet of paper, where a sizing agent is melted to cover the pulp surface or to disperse on the surface.

In the externally-adding sizing treatment, a sizing agent is applied to or impregnated into a sheet of paper. As a sizing agent, natural resin, nitrocellulose or cellulose acetate into which cellulose has been transformed, or a synthetic macromolecular material is used after liquidized and emulsified.

Acoustic paper diaphragms are described in Patent documents 1 and 2. In Patent document 1, an acoustic paper diaphragm formed of cone paper coated with a layer containing bacterial cellulose is described. In Patent document 2, an acoustic paper diaphragm formed of a sheet including a compound containing glass particles and polyamide resin is described.

[Patent Document 1] Published Japanese Patent Application No. H9-84175

[Patent Document 2] Published Japanese Patent Application No. 2001-298791

SUMMARY OF THE INVENTION

In the past, the above-described sizing agents and sizing treatments have been employed to improve moisture resistance and strength of acoustic paper diaphragms. However, from an ecological viewpoint, pulp that is the main component of paper has biodegradability and is therefore ecologically acceptable, whereas the sizing agents used have no biodegradability, which becomes hindrance to the ecological merit that paper has.

In light of the above-described points, the present invention is to provide an eco-friendly acoustic paper diaphragm in which characteristics required for an acoustic paper diaphragm such as moisture resistance and improvement in strength are maintained without hindering the biodegradability of pulp that is the main component of an acoustic paper diaphragm; and to provide an acoustic transducer apparatus including the acoustic paper diaphragm.

An acoustic paper diaphragm according to the present invention is formed of paper in which polylactide resin emulsion that is a biodegradable polymeric material is internally added as a sizing agent.

According to the acoustic paper diaphragm of the present invention, since polylactide resin emulsion is used as an internally added sizing agent, the biodegradability of paper is not impaired. Further, with respect to this acoustic paper diaphragm, moisture resistance is improved, and acoustic characteristics are improved because the properties of polylactide such as modulus of elasticity affecting the paper diaphragm.

An acoustic transducer apparatus according to the present invention includes the above-described paper diaphragm in which polylactide resin emulsion that is a biodegradable polymeric material is internally added as a sizing agent.

According to the acoustic transducer apparatus of the present invention, since the acoustic paper diaphragm is formed of paper in which polylactide resin emulsion that is a biodegradable polymeric material is internally added as a sizing agent, moisture resistance and acoustic characteristics of the acoustic paper diaphragm are maintained and the biodegradability of the acoustic paper diaphragm is not impaired.

According to an acoustic paper diaphragm of the present invention, since polylactide resin emulsion is used as an internally-added sizing agent, an acoustic paper diaphragm can be obtained in which eco-friendliness is improved and which has favorable moisture resistance and acoustic characteristics.

According to an acoustic transducer apparatus of the present invention, an eco-friendly acoustic transducer apparatus can be obtained, because the above-described acoustic paper diaphragm is included.

DESCRIPTION OF THE PREFERRED EMBODIMENTS

Figure 1:
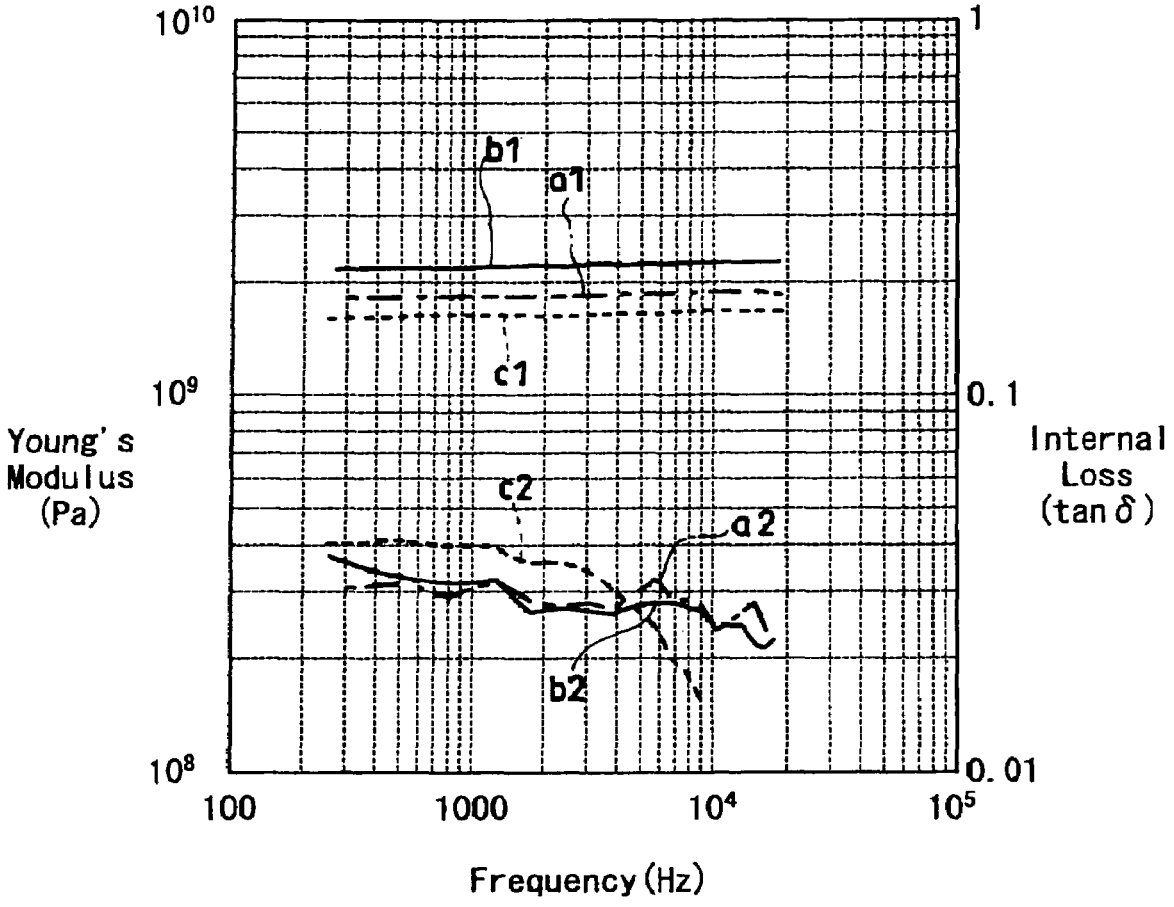
FIG. 1 is a graph showing the vibration frequency dependence of Young's modulus and the internal loss (tan δ) of polylactide size internally-added paper according to the present invention, of conventional pulp-only paper and of latex size internally-added paper.

Hereinafter, embodiments of the present invention will be explained.

Polylactide is a polymeric material originated from plants and is a resource-circulating type biodegradable polymer which decomposes into water and carbon dioxide by composting treatment after the use and then returns to plants by means of photosynthesis. Polylactide has been developed as a molding material, and has been typically used as injection molded products, fibers or films. In recent years, what is called emulsion in which polylactide is made minute and dispersed in water to be used for more variety of purposes has been commercially available and has been used as hot-melt adhesive and coating materials applied to the surface of paper and the like.

The inventors of the present invention have found that when polylactide resin emulsion is added to pulp slurry in papermaking and aluminum sulfate ($Al_2(SO_4)_3 18H_2O$) is further added, polylactide is fixed on the surface of pulp, in other words, polylactide resin emulsion can be applied as an internally-added sizing material, and also found that paper subjected to the sizing treatment is suitable for an acoustic paper diaphragm of a loudspeaker or the like after studying characteristics thereof, thereby completing an acoustic paper diaphragm with excellent acoustic characteristics and eco-friendliness.

Specifically, in the embodiments of the present invention, polylactide resin emulsion that is a biodegradable polymeric material is used as an internally-added sizing agent, and an acoustic paper diaphragm for an acoustic transducer apparatus such as a loudspeaker is formed of paper to which the internally-adding sizing treatment is performed using the polylactide resin emulsion. Further, an acoustic transducer apparatus including such acoustic paper diaphragm is formed.

An acoustic paper diaphragm according to the embodiments of the present invention is formed of paper to which internally-adding sizing treatment is performed using polylactide resin emulsion, so that eco-friendliness can be improved without impairing the biodegradability. Moreover, moisture resistance and acoustic characteristics are improved.

Further, an acoustic transducer apparatus according to the embodiments of the present invention includes the acoustic paper diaphragm which is eco-friendly and which has excellent moisture resistance and acoustic characteristics, so that an eco-friendly acoustic transducer apparatus can be provided.

PRACTICE EXAMPLES

Hereinafter, the present invention will be explained referring to practice examples, however, those practice examples are only representing ones according to the present invention and the present invention is not limited thereto.

Practice Example 1

Unbleached kraft pulp was made into a pulp slurry at 500 ml freeness (Canadian standard) according to TAPPI (Technical Association of Pulp and Paper Industry: the United States) Standards. After polylactide resin emulsion of 20% in dry weight ratio (solid content) was added to the pulp slurry and polylactide resin emulsion was fixed on the pulp surface by adding aluminum sulfate of 5%, a sample of 200 mm×250 mm in size and about 95.0 g/m$^2$ was made by a TAPPI paper machine.

As the polylactide resin emulsion, Landy PL-2000 produced by Miyoshi Oil & Fat Co., Ltd. was used.

Comparative Example 1

Unbleached kraft pulp was made into pulp slurry at 500 ml freeness (Canadian standard) according to TAPPI standards, and a comparative sample 1 formed of only pulp of 200 mm×250 mm in size and about 91.0 g/m$^2$ was made by a TAPPI paper machine.

Comparative Example 2

Unbleached kraft pulp was made into pulp slurry at 500 ml freeness (Canadian standard) according to TAPPI standards. After rubber-based latex (Nipol 1571 produced by Zeon Corporation) of 20% in pulp ratio was added to the pulp slurry as a sizing agent and rubber-based latex was fixed on the pulp surface by adding aluminum sulfate of 5%, a comparative sample 2 of 200 mm×250 mm in size and about 94.6 g/m$^2$ was made by a TAPPI paper machine.

[Measurement 1]

The tensile strength and elongation in dry condition and in wet condition were measured with respect to each of the samples of practice example 1 in which polylactide resin emulsion was added as an internally added sizing agent, comparative example 1 which was formed of only pulp, and comparative example 2 in which rubber-based latex was added as an internally-added sizing agent, and the sizing effect was compared with each other. The results are shown in Table 1.

Measurement Conditions:

Sample Size: 150 mm in length, 15 mm in width

Tensile Velocity: 10 mm/min

Dry Sample: preserved at room temperature (about 25° C. and humidity 35%) more than 24 hours Wet Sample: after immersed in ion implantation exchange water for 30 minutes, water on the surface is removed with filter paper

TABLE 1

| | | Sample | Sample | Dry Condition | | Wet Condition | |
|---|---|---|---|---|---|---|---|
| | | Weight (g/m$^2$) | Thickness (mm) | Strength (kg/cm) | Elongation (%) | Strength (kg/cm) | Elongation (%) |
| Comparative Example 1 | Only Pulp | 91.0 | 0.13 | 3.9 | 3.9 | 0.2 | 2.0 |
| Comparative Example 2 | Latex Size | 94.6 | 0.13 | 4.4 | 5.5 | 0.56 | 5.8 |
| Practice Example 1 | Polylactide Size | 95.0 | 0.13 | 5 | 5.4 | 0.8 | 6.8 |

According to the results of Table 1, comparing the tensile strength in wet condition, the sample of practice example 1 using polylactide size has four times higher value than that of the sample of comparative example 1 formed of only pulp, hence it is obvious that the sample of practice example 1 has greater sizing effect. Further, when comparing the value with that of the sample of conventional latex size, polylactide size has greater sizing effect. Accordingly, it is obvious that polylactide resin emulsion is absorbed into pulp to show the sizing effect.

[Measurement 2]

Measurement of the vibration frequency dependence of Young's modulus and the internal loss (tan δ) was carried out with respect to the samples of practice example 1, comparative example 1 and comparative example 2, using the vibrating reed method. The results are shown in FIG. 1. In FIG. 1, characteristic curves a1 and a2 are of the sample formed of only pulp, characteristic curves b1 and b2 are of the sample in which polylactide size was internally added, and characteristic curves c1 and c2 are of the sample in which latex size was internally added.

The sample in which polylactide size was internally added is high in Young's modulus in comparison with the sample in which latex size was internally added. Further, when the internal loss is compared, the sample in which latex size was internally added falls greatly in the high frequency range, whereas the sample in which polylactide size was internally added shows approximately the same internal loss as the sample formed of only pulp and is relatively stable up to the high frequency range. In other words, with respect to paper using as a sizing agent the polylactide resin emulsion according to the present invention, frequency dependence of properties are not observed, so that it is obvious that the paper has properties suitable for the material for an acoustic diaphragm.

Practice Example 2

Figure 2:
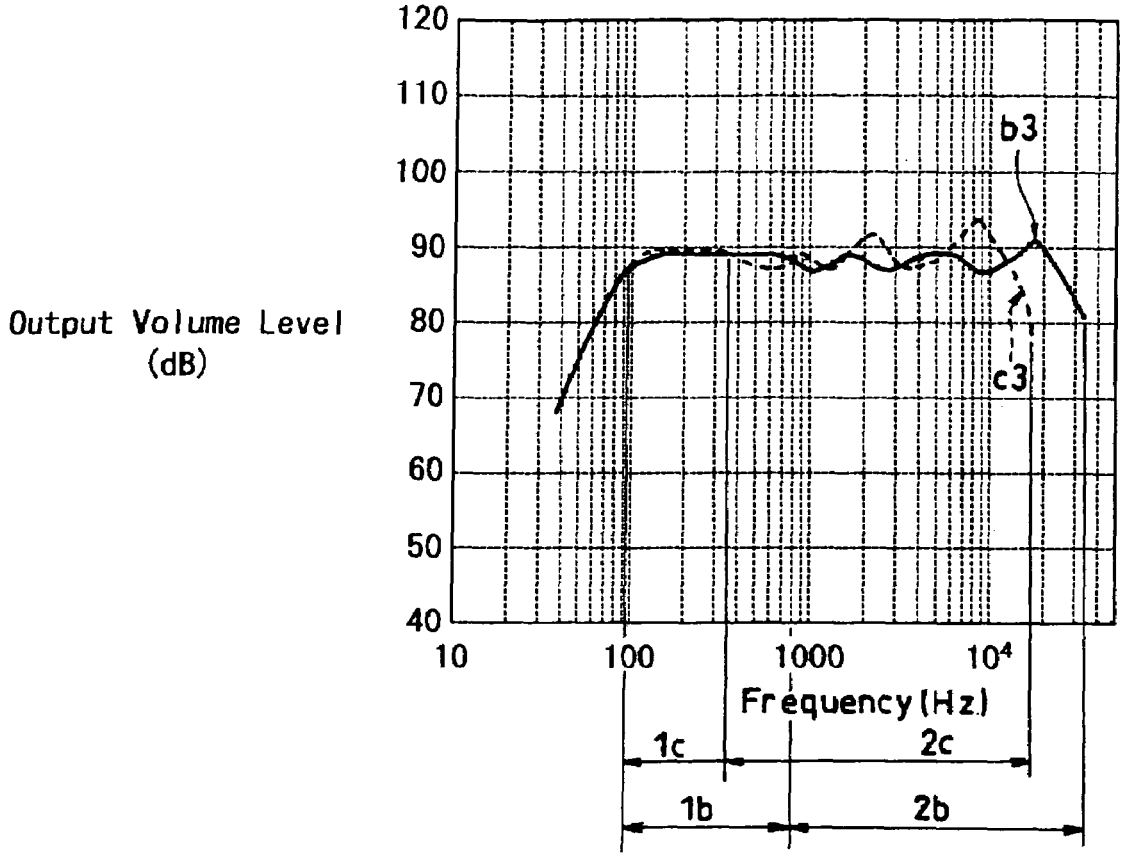
FIG. 2 is a graph showing frequency characteristics of a loudspeaker whose cone is made of polylactide size internally added-paper according to the present invention, and of a loudspeaker whose cone is made of conventional latex size internally-added paper.
Figure 3A:
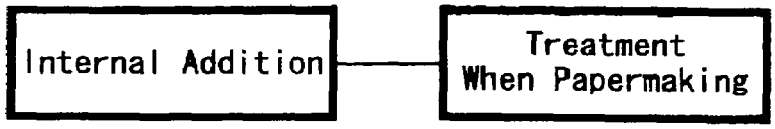
FIGS. 3A and 3B are explanatory diagrams showing internal addition and external addition of the sizing treatment.
Figure 3B:
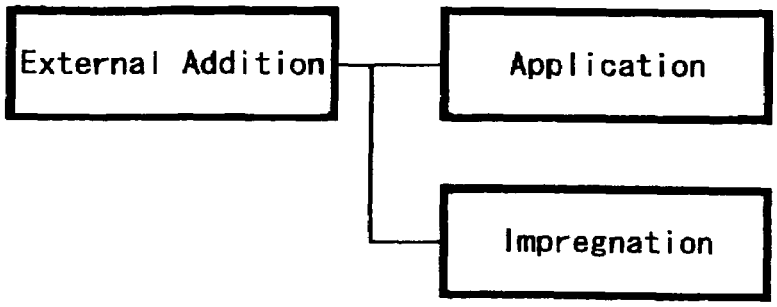

A loudspeaker cone was made using the paper material of the above-described practice example 1 in which polylactide size was internally added, and so a full-range loudspeaker of 12 cm in diameter was made. For comparison, a loudspeaker cone was similarly made using the paper material of the above-described comparative example 2 in which latex size was internally added, and so a full-range loudspeaker of 12 cm in diameter was made. The results obtained by measuring and comparing frequency characteristics of both the full-range loudspeakers are shown in FIG. 2. The solid line b3 shows a characteristic of the loudspeaker of the paper material in which polylactide size was internally added, and the broken line c3 shows a characteristic of the loudspeaker of the paper material in which latex size was internally added. As is obvious from FIG. 2, with respect to the characteristic b3 of the loudspeaker of the paper material in which polylactide size was internally added, it is verified that the piston area increases from 1*c* to 1*b*, and peaks and dips caused by divided vibrations in the high frequency range are reduced, resulting from high Young's modulus and the internal loss that is stable up to a high frequency. Symbols 2*b* and 2*c* show respective divided vibration areas.

[Measurement 3]

In order to verify the biodegradability, the polylactide size internally-added paper, the pulp-only paper, and the latex size internally-added paper, which were made in practice example 1, comparative example 1 and comparative example 2 respectively, were buried for a month in planting soil commercially available, and the states thereof were observed. The conditions of the planting soil were at a temperature of about 30° C. and moisture percentage 30%.

As a result, tattered pieces were observed with respect to the polylactide size internally-added paper and the pulp-only paper, however, the latex size internally-added paper remained stable and the state of degradation was not observed. With observing visually, it has been verified that polylactide size has similar degradability to paper.

With the above-described experimental results, an acoustic paper diaphragm according to the present invention made of paper in which polylactide size was internally added is eco-friendly and has favorable moisture resistance and acoustic characteristics. Therefore, an acoustic transducer apparatus including a loudspeaker or the like using this acoustic paper diaphragm is also eco-friendly and has favorable moisture resistance and acoustic characteristics.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. An acoustic paper diaphragm comprising:

paper in which polylactide resin emulsion that is a biodegradable polymeric material is internally added as a sizing agent to pulp slurry used to produce the acoustic paper.

2. An acoustic transducer apparatus comprising:

a paper diaphragm in which polylactide resin emulsion that is a biodegradable polymeric material is used as an internally-added sizing agent added to pulp slurry used to produce acoustic paper and internally-adding sizing treatment is performed.

3. A loudspeaker comprising:

a paper diaphragm in which polylactide resin emulsion that is a biodegradable polymeric material is used as an internally-added sizing agent added to pulp slurry used to produce acoustic paper and internally-adding sizing treatment is performed.

* * * * *